United States Patent [19]

Pawlowski

[11] 4,441,608

[45] Apr. 10, 1984

[54] DISPLAY CARTON

[75] Inventor: Thomas D. Pawlowski, Neenah, Wis.

[73] Assignee: James River-Dixie/Nortern, Inc., Norwalk, Conn.

[21] Appl. No.: 259,679

[22] Filed: May 1, 1981

[51] Int. Cl.[3] ..... B65D 5/50; B65D 85/14

[52] U.S. Cl. ..... 206/45.14; 206/277; 206/476; 206/486

[58] Field of Search ..... 206/45.13, 45.14, 45.19, 206/45.31, 277, 476, 485, 486, 487, 491; 229/16 D, 27, 39 B

[56] References Cited

U.S. PATENT DOCUMENTS

| | | | |
|---|---|---|---|
| 2,435,135 | 1/1948 | Franck | 229/16 D |
| 3,027,996 | 4/1962 | Transport | 206/45.14 |
| 3,378,135 | 4/1968 | Stone | 206/45.14 |
| 3,378,137 | 4/1968 | Stone | 206/45.14 |
| 3,419,133 | 12/1968 | Stone | 206/45.14 |
| 3,682,297 | 8/1972 | Austin et al. | 206/45.31 |
| 3,712,461 | 1/1973 | Schillinger | 206/45.14 |
| 3,750,870 | 8/1973 | Cote | 206/45.14 |
| 3,901,382 | 8/1975 | Roccaforte | 206/45.14 |
| 4,155,445 | 5/1979 | Roccaforte | 206/45.14 |
| 4,264,006 | 4/1981 | Swanberg | 206/45.19 |

*Primary Examiner*—George E. Lowrance
*Assistant Examiner*—Jimmy G. Foster
*Attorney, Agent, or Firm*—Finnegan, Henderson, Farabow, Garrett & Dunner

[57] ABSTRACT

A carton blank, and a display carton erected therefrom, are adapted for securely holding a tube in a specially-designed cradle means made from a unitary panel of the carton. The unitary panel has a first cut line extending generally along the width dimension at the top end. A second cut line extends from the first cut line along the length of the cradle means, terminating at a point short of the bottom end. Third and fourth cut lines are spaced outwardly on opposite sides of the second cut line and extend along the length of the cradle. Score lines extend in angular relationship from the third and fourth cut lines toward the bottom end of the cradle means. A tab on the bottom end of the cradle means is adapted for engaging a chime on the tube cap and preventing the tube from inadvertent displacement from the carton.

14 Claims, 5 Drawing Figures

DISPLAY CARTON

BACKGROUND OF THE INVENTION

This invention is an improvement in display cartons which display a product-containing tube, or the like. Cartons for holding and displaying tubes are known. One such carton, over which this invention is an improvement, is shown in FIG. 5, and has a cradle for holding the tube in place. The cradle has a perforated panel across the width of the cradle, and top and bottom flaps depending from the top and bottom edges of the cradle. The bottom flap has a transverse cut for holding the fin shaped bottom of the tube. The top flap has a hole for holding the top of the tube.

The perforated panel may be broken at the perforations when the tube is inserted into the carton. In the completed package, the cradle is usually composed of four elements; the top and bottom flaps, and the two parallel panels of the broken perforated panel.

It is an object of this invention to provide a carton having an improved cradle for holding the tube.

It is another object to provide a cradle which is comprised of a unitary support member across the length and width of the cradle.

It is a specific object to provide improved cradle design, in which the cradle is comprsied of a unitary support member, in which the unitary cradle may be resiliently deformed inwardly of the carton, and in which a chime holding tab engages the chime of the tube cap—so that a single carton may be used for the packaging of a plurality of sizes of tubes.

SUMMARY OF THE INVENTION

It has now been found that certain of the foregoing objects are achieved in a carton having a plurality of carton walls wherein the carton has cradle means for holding an elongated container, the cradle means having top and bottom ends, and a length dimension therebetween with which the length dimension of the elongated container is to be aligned, and two sides and a width dimension therebetween, the width dimension being defined perpendicular to the length dimension.

The cradle means is constructed of a unitary panel of carton material. The panel has a first cut line, which is spaced from the bottom end and extends generally along the width dimension of the cradle means. The first cut line is sufficiently long as to receive a fin shaped end of the container to be packaged in the carton.

A second cut line extends from the first cut line in a direction along the length of the cradle means and terminates at a point short of the top end. An imaginary line, extending through the recited point, along the width dimension, divides the cradle into a bottom portion corresponding to the bottom end, including the first cut line, and a top portion, corresponding to the top end.

Third and fourth cut lines are spaced on opposite sides of the second cut line, between the second cut line and the sides. Each of the third and fourth cut lines extends from the bottom portion of the cradle to the top portion of the cradle.

Score lines extend from the third and fourth cut lines, in angular relationship with the third and fourth cut lines, toward the top end of the cradle means.

In a preferred embodiment, portions of the third and fourth cut lines located, lengthwise, between the recited point on the second cut line and the top end of the cradle means are coextensive, and a retaining tab projects from the top end of the cradle between portions of the third and fourth cut lines; and the score lines intersect the third and fourth cut lines at the coextensive portions.

DETAILED DESCRIPTION OF THE ILLUSTRATED EMBODIMENT

Figure 1:
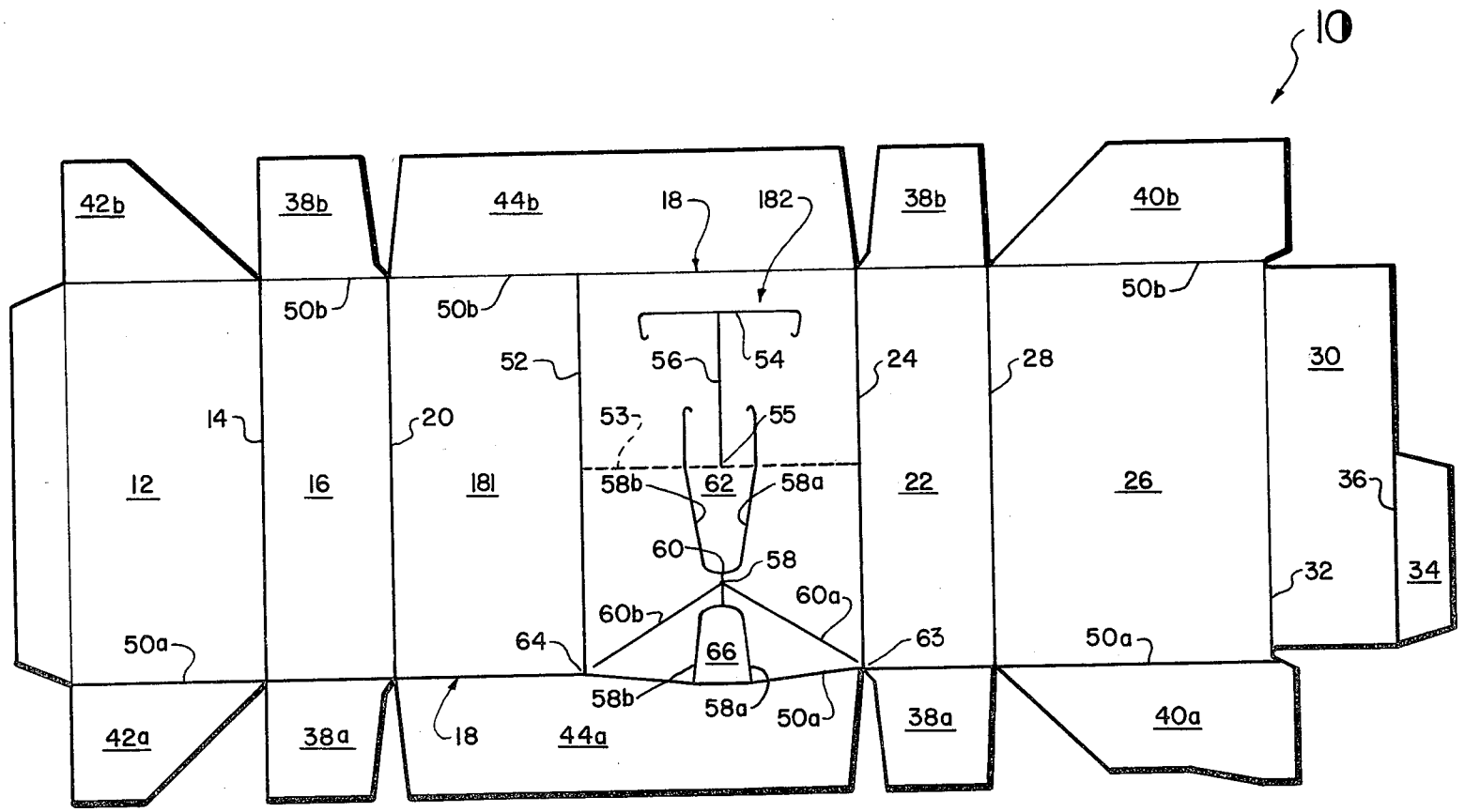
FIG. 1 is a plan view of a carton blank illustrative of the invention.
Figure 2:
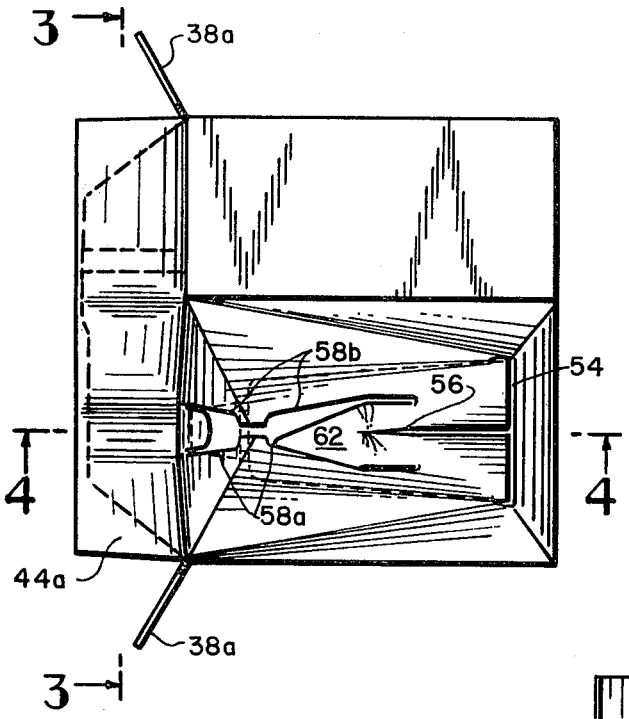
FIG. 2 is a top view of the set up carton, with a product holding tube shown in phantom outline, and held in the cradle.
Figure 3:
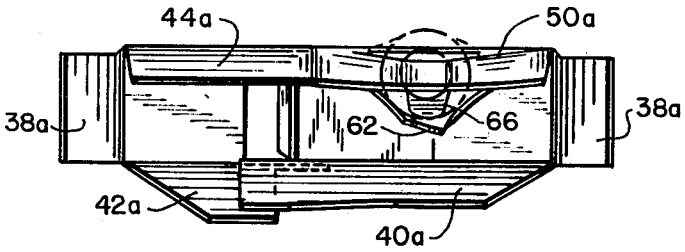
FIG. 3 is an end view of the inside of a set up carton, taken at 3—3 in FIG. 2.
Figure 4:
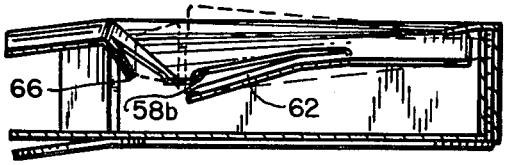
FIG. 4 is a cross-section of the cradle portion taken at 4—4 in FIG. 2 and looking in the direction indicated.
Figure 5:
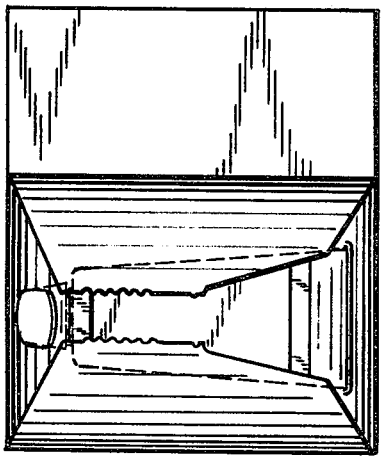
FIG.5 PRIOR ART
FIG. 5 is a prior art carton having a substantially different cradle.

A carton blank of this invention is illustrated in FIG. 1. A set up carton, with a product tube in phantom outline, is shown in FIG. 2. FIGS. 3 and 4 illustrate the interior of the carton.

In FIG. 1 the carton blank is generally designated 10. Beginning at the left side of the blank, rear wall panel portion 12 is hingedly connected by hinge line 14 to side wall 16.

Side wall 16 is hingedly connected to the front wall 18 by hinge line 20. Front wall 18 is connected to side wall 22 by hinge line 24. Side wall 22 is connected to rear wall panel 26 by hinge line 28. Rear wall panel 26 is connected to bridging panel 30 by hinge line 32. Bridging panel 30 is connected to glue flap 34 by hinge line 36. Dust flaps **38*a* and 38*b* depend from side walls 16 and 22. End closure flaps 40*a* and 40*b* depend from rear wall panel 26, and end closure flaps 42*a* and 42*b* depend from rear wall panel 12. End closure flaps 44*a* and 44*b* depend from front wall 18. Flaps 38*a*, 40*a*, 42*a*, and 44*a* are connected to their respective walls and wall panels by hinge line 50*a*. Flaps 38*b*, 40*b*, 42*b* and 44*b* are connected to their respective walls and wall panels by hinge line 50*b***.

Front wall 18 is defined by hinge lines **20, 24, 50*a* and 50*b*; and is divided by hinge line 52 into two wall sections, 181 and 182. Section 181** is generally planar and rectangular and is conveniently used for advertising and the like.

Section 182 is cut and scored to form a cradle for holding a tube. In describing section 182 as a cradle, the top end of the cradle is at hinge line **50*b*, the bottom end of the cradle is at hinge line 50*a*, and the left and right sides of the cradle are at hinge lines 52 and 24 respectively. The length dimension extends parallel to hinge lines 24 and 52. The width dimension extends generally parallel to hinge line 50*b***.

Cut line 54 is spaced from the top end **50*b***, and extends generally along the width dimension. Its length is sized to be sufficiently long, in the width dimension of the cradle, to receive the closed, fin-shaped end of the tube.

Cut line 56 extends from cut line 54 toward the bottom of the cradle, terminating at a point 55 short of hinge line **50*a***.

Cut lines **58*a* and 58*b* are spaced on either side of cut line 56, beginning between cut line 54** and an imaginary line 53 through point 55 perpendicular to line 56. Lines 58*a* and 58*b* generally extend toward the bottom end of the cradle, converging at an intermediate location 60 between point 55 and the bottom end of the cradle, to form a tongue 62. As here embodied, the lines 58*a* and 58*b* are co-extensive from point 60 through the hinge lines 60*a* and 60*b* to the closest end of tab 66. At the end of tab 66 closest to point 60, lines 58*a* and 58*b* separate and comprise the cut lines that form the tab 66. Lines 58*a* and 58*b* finally terminate at hinge line 50*a*.

Hinge lines 60*a* and 60*b* extend from point 58 to the intersections of hinge line 50*a* with hinge lines 24 and 52 at points 62 and 64 respectively.

Hinge line 50*a* deviates from a straight line between points 63 and 64, and bows outwardly in the direction of end closure flap 44*a*.

In assembly of the carton, panels 30 and 26, and glue flap 34 are rotated about hinge line 28, so that glue flap 34 is brought over panel 181 and adhered to it by suitable adhesive. Panels 12 and 16 are then rotated about hinge line 20, and panel 12 is adhered to panel 26. The carton is then erected by pushing hinge lines 20 and 28 toward each other.

When the carton is erected, the top and bottom carton ends may be closed in a manner now described for the bottom end of the carton. First, dust flaps 38*a* are folded in. Then flap 42*a* is folded inwardly; and because a portion of 42*a* is outward of that portion of flap 40*a* which extends beyond an imaginary extension not shown, of hinge line 32, flap 40*a* is carried along a flap 42*a* is folded in. Finally, flap 44*a* is folded down over flaps 40*a* and 42*a* and adhered to them.

In putting the tube into the package, the fin end of the tube is inserted into cut line 54. The body of the tube is then pressed downwardly into the cradle. The sides of the cradle, they being generally outwardly of cut lines 58*a* and 58*b* deflect resiliently downwardly about hinge lines 24 and 52 respectively. The shoulders of the cradle, being between hinge line 50*a* and the two hinge lines 60*a* and 60*b*, deflect resiliently downwardly, and tab 66 engages the chime on the tube cap, thus holding the tube in the carton; and preventing it from being pushed outwardly of the carton. The cradle tab combination is a dynamic mechanism for firmly holding the tube in place. The sides and shoulders, which were resiliently deflected, resist the inward deflection when the tube is put into the package, and provide a lifting force on the tube which tends to maintain tab 66 in firm contact with the chime of the tube cap. Thus tab 66 limits the outward movement of the tube and the shoulders and sides are biased to limit the inward movement of the tube. Tongue 62 further reinforces control of the inward movement of the tube.

With this construction, moderate variations in tube size can be accommodated by a single carton size; in that tubes of a range of diameters may be inserted into a given cradle, so long as the cap chime locations are sized for proper engagement by tab 66.

Tab 66 may be properly designed in combination with the cap, so that, when tab 66 engages the chime, the edges of the shoulders at 58*a* and 58*b* engage the exterior surface of the sides of the cap, providing a secondary means for preventing inadvertent displacement of the tube from the carton.

Thus it is seen that the invention provides a carton having an improved cradle for holding a tube; and the cradle is comprised of a unitary support member.

Further, the improved cradle may be resiliently deformed inwardly of the carton, and a chime holding tab may engage a chime of the tube cap.

Having thus described the invention, what is claimed is:

1. A carton having cradle means for holding an elongated container, said cradle means having top and bottom ends, top and bottom portions respectively adjacent said top and bottom ends and a length dimension between said ends with which the length dimension of the elongated container is to be aligned, and two sides and a width dimension therebetween, said width dimension being defined perpendicular to said length dimension, said cradle means comprising:

(a) a unitary panel of carton material, said panel having a first cut line therein, said cut line being spaced from said top end and extending generally along the width dimension of said cradle means, and being sufficiently long as to receive a fin of the container to be packaged in the carton;

(b) a second cut line extending from said first cut line in a direction along the length of said cradle means and terminating at a point a distance from said bottom end;

(c) third and fourth cut lines on opposite sides of said second cut line, spaced between said second cut line, and said sides, each of said third and fourth cut lines extending from the top portion of said cradle into the bottom portion of said cradle, said second, third and fourth cut lines forming a supporting panel, said third and fourth cut lines being connected to form said supporting panel into a tongue-like panel which will accommodate and support containers of various dimensions;

(d) and score lines extending from said third and fourth cut lines toward the bottom end of said cradle means.

2. A carton as in claim 1, including a retaining tab adjacent said bottom end, said tab having a longitudinal axis generally aligned with said second cut line.

3. A carton as in claim 2 wherein said connected third and fourth cut lines form said supporting panel into a U-shaped tongue.

4. A carton as in claim 3 wherein said cradle means includes a fifth cut line between said tongue and said tab, said fifth cut line being generally co-linear with said second cut line.

5. A carton as in claim 4 wherein said score lines intersect said fifth cut line.

6. A carton as in claim 1 wherein said cradle means is generally rectangular in shape with said second cut line being generally perpendicular to said first cut line and extending through the middle of said rectangular shape.

7. A carton as in claim 5 wherein said cradle means is rectangular in shape and said second and fifth cut lines extend through the middle of said rectangular shape.

8. A carton blank erectable into a carton, said carton having cradle means for holding an elongated container, said cradle means having top and bottom ends, top and bottom portions respectively adjacent said top and bottom ends and a length dimension between said ends with which the length dimension of the elongated container is to be aligned, and two sides and a width dimension therebetween, said width dimension being defined perpendicular to the length dimension, said cradle means comprising;

(a) a unitary panel of carton material, said panel having a first cut line therein, said cut line being spaced from said top and extending generally along the width dimension of said cradle means, and being sufficiently long as to receive a fin of the container to be packaged in the carton;

(b) a second cut line extending from said first cut line in a direction along the length of said cradle means and terminating at a point a distance from said bottom end;

(c) third and fourth cut lines on opposite sides of said second cut line, spaced between said second cut line, and said sides, each of said third and fourth cut lines extending from the top portion of said cradle into the bottom portion of said cradle, said second, third and fourth cut lines forming a supporting panel, said third and fourth cut lines being connected to form said supporting panel into a tonque-like panel which will accommodate and support containers of various dimensions;

(d) and score lines extending from said third and fourth cut lines toward the bottom end of said cradle means.

9. A carton blank as in claim 8, including a retaining tab adjacent said bottom end having a longitudinal axis generally aligned with said second cut line.

10. A carton blank as in claim 9 wherein said connected third and fourth cut lines form said supporting panel into a U-shaped tongue.

11. A carton as in claim 10 wherein said cradle means includes a fifth cut line between said tongue and said tab, said fifth cut line being generally co-linear with said second cut line.

12. A carton blank as in claim 11 wherein said score lines intersect said fifth cut line.

13. A carton blank as in claim 12 wherein said cradle means is rectangular in shape and said second and fifth cut lines extend through the middle of said rectangular shape.

14. A carton blank as in claim 8 wherein said cradle means is generally rectangular in shape with said second cut line being generally perpendicular to said first cut line and extending through the middle of said rectangular shape.

* * * * *